United States Patent [19]

Abrishamian et al.

[11] Patent Number: 4,765,257

[45] Date of Patent: Aug. 23, 1988

[54] APPARATUS AND METHOD FOR WASTE DISPOSAL

[75] Inventors: Ramin Abrishamian, Needham; Richard P. de Filippi, Cambridge, both of Mass.

[73] Assignee: CF Systems Corporation, Waltham, Mass.

[21] Appl. No.: 127,785

[22] Filed: Dec. 2, 1987

[51] Int. Cl.[4] ..... F23B 7/00; F23G 7/04

[52] U.S. Cl. ..... 110/342; 110/346; 110/238; 432/72

[58] Field of Search ..... 110/218–221, 110/238, 210, 211, 212, 342, 346

[56] References Cited

U.S. PATENT DOCUMENTS

| | | | |
|---|---|---|---|
| 4,140,467 | 2/1979 | Ellison et al. | 432/72 |
| 4,217,090 | 8/1980 | Whike et al. | 432/72 |
| 4,531,463 | 7/1985 | Kratz et al. | 110/342 |
| 4,648,333 | 3/1987 | Mudd et al. | 110/238 |

*Primary Examiner*—Henry C. Yuen

*Attorney, Agent, or Firm*—Schiller, Pandiscio & Kusmer

[57] ABSTRACT

Apparatus for and method of thermally decomposing wastes laden typically with organic solvents, other organic liquids and soluble organic materials, by first extracting such wastes in a pressure vessel using a fluid extractant in which the organics are soluble, thereby producing a fluid extract of the organics in the extractant fluid and a non-extracted residue of reduced BTU/lb value. The extractant fluid, typically propane, is preferably a gas at ordinary conditions of temperature and pressure but in the pressure vessel means is held to conditions of temperature and pressure sufficient to render the extractant fluid a solvent for the organics. Means are provided for separating the residue from the organics extracted from the waste material, and the residue is burned typically in a solids incinerator. The fluid extract is separated into an extracted organics fraction and an extractant fraction, the latter being recycled for use in the pressure vessel. The extracted organics fraction is employed as auxiliary fuel for either the solids incinerator or for an afterburner to which the flue-gases from the incinerator are fed for further, high temperature incineration.

14 Claims, 2 Drawing Sheets

APPARATUS AND METHOD FOR WASTE DISPOSAL

Figure 1:
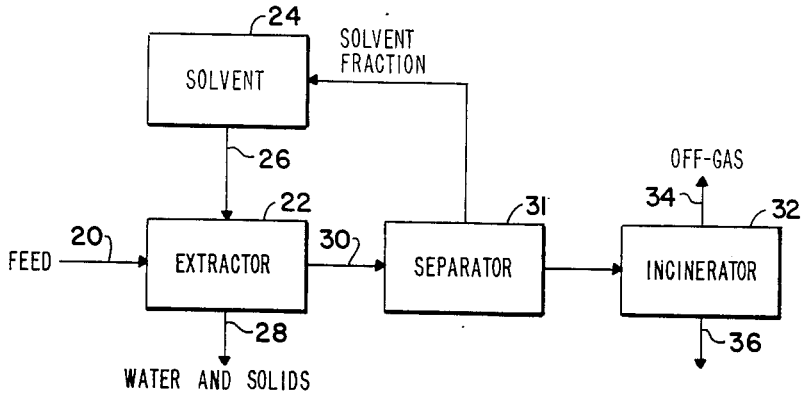

This invention relates to thermal decomposition systems for wastes, and more particularly to improved and more efficient apparatus for and method of thermal decomposition of wastes containing organic constituents.

A preferred method for disposing of organics-containing wastes having a substantial solids content, particularly toxic wastes, is by incineration. Typically, such wastes are fed to a solids incinerator, such as a rotary kiln, which volatilizes and/or combusts the organic content of the material. Where the solid content of the waste is very low (e.g. less than about 15%), the waste may be fed to a furnace directly through nozzles in atomizing-type burners that mix the air and waste together. If the waste fuel will not support its own combustion, auxiliary fuels may be employed. The resulting ash may be relatively non-polluting or, if it contains undesirable components such as metals, it is treated by chemical fixation or the like to preclude leaching of the metals following landfill disposal of the ash. The gases driven off in the process may be fed to a second chamber or afterburner where, at high temperatures, the gases are burned to form typically $CO_2$, water, $NO_X$, $SO_X$ and the like as the major flue or off-gas components. The flue gas can then be scrubbed to remove undesirable components. The scrubbing equipment is sized according to the temperature and volume of the gas to be processed, and is thus related to the amount of heat generated, i.e. BTU/hr. Characteristically, waste containing a large fraction of organic liquid has usually a high heating value, i.e. BTU/lb.

The term "incinerator" as used herein is intended to mean furnaces designed to dispose of waste products with minimal production of polluting ash and gases, and hence includes furnaces in which any kind of thermal destruction and/or thermal decomposition occurs, whether by combustion, partial pyrolysis or complete pyrolysis.

A number of problems are associated with such incineration methods. For example, there is a limit to the amount of heat generated (number of BTU/hr) that can be handled in the portion of an incinerator system dealing primarily with solids. Many wastes, particularly toxic wastes, are supplied to an incinerator facility in the form of barrels or drums of sludge. Each barrel typically must be sampled to determine the approximate BTU/lb value of the sludge to avoid overloading the incinerator and/or to avoid causing explosions. This procedure is time consuming and may add considerably to the cost of waste disposal.

Also, because incinerator operators typically charge in dollars/lb for disposal, greater monetary gain can be achieved by feeding into the incinerator materials that have a relatively low BTU/lb value, thereby obtaining a greater throughput in terms of lbs/hr. It may not, however, be practical to expect an incinerator operator to accept only one class of sludge among the many types of waste sludge available, particularly where the incinerator operator may be servicing a large and diverse number of customers with varying needs and requirements.

Additionally, waste supplied as sludge tends to be difficult to handle, especially in terms of consistent rates of feeding the sludge into the incinerator.

Where the organic waste is contained in an aqueous emulsion or other aqueous material relatively free of solids content, a solids incinerator is not necessary, but it is usually desirable to separate out a substantial portion of the water before thermally decomposing the organics. Also, if the waste contains low levels of non-combustible solids (i.e. about 15% or less), it may be more desirable to remove the solids portion prior to thermal decomposition of the organics, both from a cost and efficiency point of view. To do so would eliminate the necessity of using a solids incinerator. Feeding solids, even finely comminuted in a suspension, directly to an afterburner may result in undesirable formation of ash in the furnace, necessitating expensive repair and shutdown.

It is therefore a primary object of the present invention to provide apparatus for and method of incinerating wastes such as water/oil emulsions, impoundment pit sludge, oily sludge from refinery operations, storage tank bottoms sludge, and the like with substantially improved incinerator operation and efficiency. It is another object of the present invention to provide a process including treatment of waste sludge to yield solids incinerator feed of substantially uniform and reduced heating value. Yet another object of the present invention is to provide such a process in which the incinerator feed consists of relatively dry, free-flowing solids comparatively easy to handle and to meter. Other objects of the invention will in part be obvious and will in part be apparent hereinafter.

The invention accordingly comprises the several steps and the relation of one or more of such steps with respect to each of the others, and the apparatus embodying features of construction, combinations of elements, and arrangement of parts which are adapted to effect such steps, all as exemplified in the following detailed disclosure, and the scope of the invention will be indicated in the claims.

Figure 2:
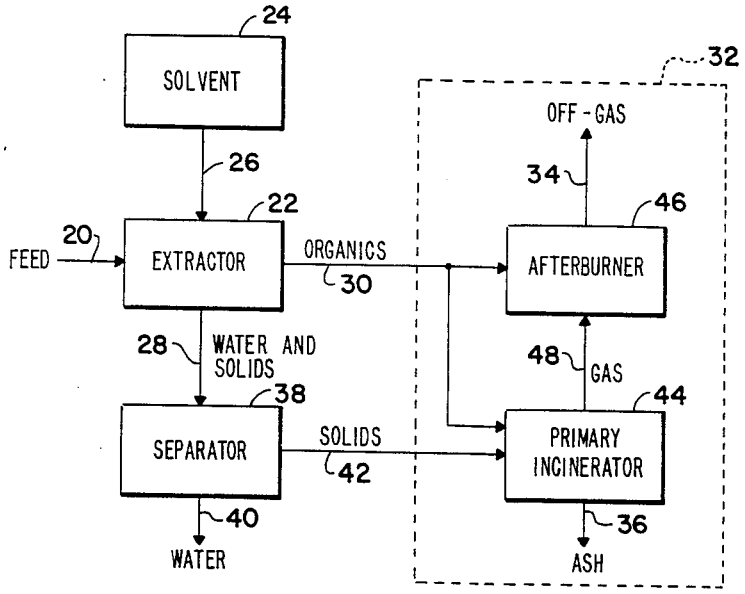
Figure 3:
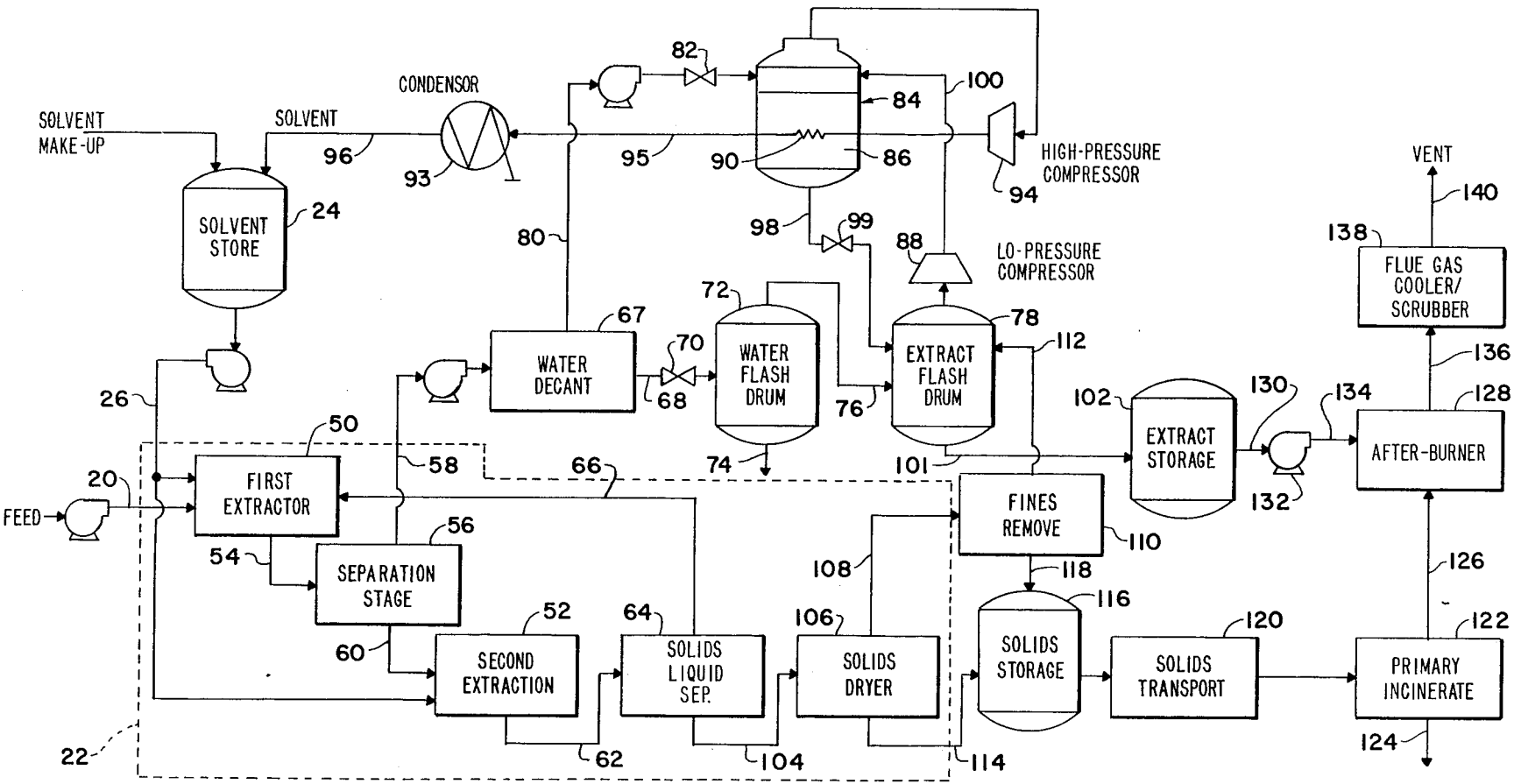

For a fuller understanding of the nature and objects of the invention, reference should be had to the following detailed description taken in connection with the accompanying drawings wherein:

FIG. 1 is a block schematic diagram of the general principles of the present invention;

FIG. 2 is a block schematic diagram of apparatus for carrying out the process of the present invention illustrating the separation of the input feed into solids, and extracted water and organic liquids; and FIG. 3 is a detailed block diagram showing a number of the elements of both the extraction and incineration stages of an embodiment of the present invention, particularly for an input waste feed with a substantial solids content.

To effect the foregoing and other objects, the present invention includes apparatus for and method of thermally decomposing wastes laden typically with organic solvents, other organic liquids and soluble organic materials, by first extracting such wastes with a fluid extractant to extract such solvents, liquids and materials. Where the waste may also include substantial solids, the extraction yields a solids incinerator feed of uniform and generally reduced heating value, lower volume, and higher flash point. The organic liquids, solvents and materials extracted are then thermally decomposed by being employed as auxiliary fuel for the solids incinerator or burned in a liquid incinerator or burned in a waste-fired boiler. Incineration of such extracted incinerator feed has been found to produce an ash with reduced organic content because of the lower concentration of organics in the solids fed to the incinerator, the reduced particle size of the solids feed, and the continuity of the operation.

According to another aspect of the present invention, there is provided a process for treating waste materials having an organics content, such process comprising the steps of contacting the waste with an extractant fluid to extract organics soluble in the fluid, the extractant fluid being a gas at ordinary conditions of temperature and pressure and contacted with the waste material under conditions of temperature and pressure sufficient to render the extractant fluid a solvent for organic components in the waste material, separating the extracted organics in the extractant fluid from the non-extracted portion of the waste, feeding the non-extracted portion of the waste to a solids incinerator system for thermal decomposition, separating the extractant from the extracted organic components, recycling the separated extractant to solvent storage for use in the extraction step, and feeding the separated extracted organic components to the incinerator system for use as a fuel. In a preferred embodiment of the present invention, the extractant fluid is propane.

According to yet another embodiment of the present invention, there is provided apparatus for extracting organics from organics-containing waste materials with an extractant fluid that is a gas under ordinary conditions of temperature and pressure but which when mixed with the waste material is at a temperature and pressure sufficient to render the extractant fluid a solvent for organics solutes in the waste material, means for separating a fluid extract of organic solutes in the extractant fluid from any non-extracted residue of the waste materials, means for depressurizing the fluid extract to provide a still feed, means for distilling the still feed to form still overhead vapors primarily comprising the extractant fluid and liquid still bottoms comprising a concentrate of the soluble organic solutes, the enthalpy required to effect this distillation being provided by compressing the overhead vapors to heat same and indirectly to heat the still feed, and means for incinerating at least the organic solutes.

In the following detailed description, the extraction of wastes, particularly in the form of sludges, will be described in connection with the use of liquified propane as the extraction solvent. It should be understood that while propane is the preferred solvent, other solvents such as light hydrocarbons that are normally gaseous at ordinary conditions of temperature and pressure, may also be used.

Many compounds that are gases at normal ambient temperatures and pressures can be converted to near or supercritical fluids by subjecting them to temperatures and pressures near or above critical limits, and the resulting fluid may have solvent properties, particularly for organic materials. This capability of a number of gases as liquids in their near critical state and as a fluid in their supercritical state to serve as an extracting solvent (hereinafter referred to solvent-condition fluids) has been long recognized. Cf., for example, Francis, A. W., J Phys. Chem. 58, 1099 (1954) and Ind. Eng. Chem. 47, 230 (1955). A detailed review of extraction using supercritical gases was published in Angewandte Chemie-International Ed., 17: 10, pp. 701–784 (October 1978).

A desirable feature of the present invention is the use of solvent extractant vapor recompression in combination with the use of solvent-condition fluids, for it permits the overhead vapor enthalpy to be used as the heat source for a still boiler that ultimately separates the solvent-condition fluid from the extracted organics, and permits the extractant fluid to be recycled for further extractions. Such vapor recompression cycle has been described in detail in U.S. Pat. No. 4,349,415.

Referring particularly to FIG. 1 there are illustrated schematically the broad principles of the present invention in an embodiment in which waste feed is introduced through line 20 into extractor means 22. Typically, where such waste feed has a relatively sparse solids content (e.g. less than about 15%), it will be in the form of a liquid suspension or the like, and can be easily transferred by pumping. Where the waste feed has a high solids content (e.g. above 60%) it may be fed through line 20 by ramming, auger feeding or the like. Extractor means 22 may be any suitable pressure vessel intended to provide efficient contact between the waste feed and a solvent-condition fluid, such as by countercurrent flow in a packed or sieve-plate tower. The waste feed is mixed in extractor means 22 with solvent-condition fluid fed from solvent storage 24 through line 26. A raffinate of water (if any) and non-extracted components, including insoluble solids, is drawn from extractor means 22 through line 28. Liquid solvent-condition fluid containing extracted organic components is withdrawn from extractor means 22 through line 30. Although under some circumstances it may be desirable to burn the liquid solvent-condition fluid as a supplementary fuel together with the extracted organic components, in one embodiment of the present invention, the fluid and extracted components are introduced into separator 31 where they are divided into a solvent fraction that is fed back to storage 24 and an extracted fraction that is fed into incinerator 32 where it is subjected to thermal decomposition or destruction, the organic components serving as their own fuel, in part or in whole. The off-gas from the thermal processing is vented through line 34 to the atmosphere, any resulting ash being withdrawn from the incinerator through line 36.

FIG. 2 on the other hand illustrates another embodiment of the present invention particularly intended to treat waste material having a relatively high solids content. As shown in FIG. 2, like numerals denoting like parts, the output from extractor means 22 is fed through line 28 to separator means 38 which can be any of a number of known filters, strainers, centrifuges, hydrocyclones and the like capable of separating the solids content from water, in whole or in part, in an aqueous slurry. Water is discharged from separator means 38 through outlet line 40. It will be seen that incinerator 32 in this case advantageously comprises two sections, solids incinerator section 44 and afterburner 46, and the separated solids are transported along line 42 to solids incinerator section 44. The organic components extracted from the waste material are withdrawn from extractor means 22 and delivered either to incinerator section 44 or to afterburner 46 or to both, serving as an auxiliary fuel for solids incinerator section 44 or as the primary fuel for afterburner 46. The exhaust or flue gas from incinerator section 44 is delivered through line 48 to afterburner 46. It will be appreciated that, as earlier noted, the higher BTU fraction of the waste will appear in the organics extracted by the extraction stage of the present invention, hence the temperature in afterburner 46 can be expected to be considerably higher than that found in incinerator section 44. Such higher temperature in the afterburner is usually necessary to complete the combustion of the gaseous effluent from incinerator section 44 so that such effluent is completely oxidized.

A more detailed description of an embodiment of the present invention, is provided hereinafter in connection with FIG. 3, it being understood that for purposes of illustration, propane will be referred to as the solvent-condition extractant and a refinery sludge with a small amount of water and with a solids content of about 30% by weight (dirt, sand, clays, waste catalysts and the like) will be considered an exemplary waste material.

The refinery sludge is pumped under pressure (e.g. 300–400 psig at typically 10°–40° C.) through an appropriate pressure line 20 into extractor means 22 formed preferably as a two-stage countercurrent system comprising first and second extractors 50 and 52. The latter are designed to insure that the feed mixture is contacted with solvent-condition propane pumped into extractors 50 and 52 through line 26 (at about the same pressure and temperature) from propane storage pressure tank 24. After a predetermined residence time in extractor 50, sufficient to reach the desired extent of solute removal, the mixed propane and sludge is fed through line 54 into solids/liquid separation stage 56, from which typically about 70% of the liquids content (water/propane/organic extract) is pumped out through line 58. The remaining propane/sludge mixture or slurry is transferred from separation stage 56 through line 60 into extractor 52 where the mixture is diluted with additional, fresh solvent-condition propane from storage tank 24. Transfer of the sludge/propane mixture from extractor 50 to 52 through separation stage 56 involves a pressure drop, typically of 20–50 psig. The sludge/-propane mixture remains in extractor 52, typically for a residence time determined by the desired degree of extraction.

The contents of extractor 52 are withdrawn through line 62 and fed into solids/liquid separator 64, typically a filter, centrifuge, decanter or the like. The liquid substantially separated from the solids in separator 64 is pumped back through line 66 to the first extractor stage 50.

The water/propane/dissolved organics liquid pumped along line 58 is fed into water decanter means 67 wherein the substantially immiscible water and propane/organics phases are separated from one another. The separated water, together with whatever small amount of residual propane may be mixed therein, is transferred through line 68 and pressure reduction valve 70 to water flash drum 72; because of the pressure reduction at valve 70, typically to atmospheric pressure, whatever liquid propane is present flashes into vapor in drum 72, substantially separating from the water. The latter is discharged from drum 72 through line 74, while the resulting propane vapor with whatever organics it might contain is fed through line 76 to extract flash drum 78.

The resulting propane solution of organics dissolved in liquid propane, separated from the water in water decanter means 67, is pumped out of the latter through line 80 and through pressure reduction valve 82 to provide a still feed, for example, at a pressure of 100 psig, to solvent recovery still 84.

Solvent recovery still 84, typically a distillation column, includes reboiler 86 coupled through high-pressure compressor 94 (for pressurizing the still overhead vapors to, for example, about 350 psig) to the overhead of the still, the still preferably having enough stages so that essentially all of the dissolved organics will collect in reboiler 86 along with residual propane to form the still bottoms. The exact temperature of the still feed at its point of introduction into still 84 is established by the pressure drop across valve 82, but the temperature of the still bottoms must be maintained at the boiling point of the liquid. Still 84 can operate over a temperature range extending from just below the critical temperature of the still feed to just above the freezing point of the still bottoms, but it is preferred to operate as near as possible to ambient temperatures. The heat supplied to reboiler 86 is provided by indirect heat exchange with the recompressed and now hot propane vapor originally drawn from the overhead of still 84 and sent in sequence through line 92, compressor 94 and line 89 into heat exchanger coils 90 in reboiler 86. The boiling point of the still bottoms provides for determination of an optimum temperature for the overhead vapor compressed by compressor 94 and fed into heat exchanger coils 90 in reboiler 86, the extent of compression provided by compressor 94 being in turn determined by the desired temperature. The temperature of the compressed vapor provided by compressor 94 to reboiler coils 90 must be higher than the boiling point of the still bottoms. The vapors exiting coils 90 along line 95 are subject to sufficient high-pressure compression in compressor 94 (e.g. from about 300–400 psig) and recooling in condensor 93, if desired, to insure that the output fluid fed to solvent storage 24 along line 96 is solvent-condition propane.

The propane vapor with whatever entrained organics it contains is fed from water flash drum 72 through line 76 as a feed to extract flash drum 78. The still bottoms are taken from still 84 and fed through line 76 and pressure-reduction valve 99 as another feed to extract flash drum 78. The propane is separated from any organics in extract flash drum 78, typically by heating. The resulting propane vapor is fed through low pressure compressor 88 and line 100 as an input feed to still 84, and the separated organic fraction is transferred, typically as a warm liquid (e.g. at about 40° C.) along line 101 to extract storage means 102.

The solids output from separator 64 is transferred along line 104 to dryer 106, in which any residual propane is separated from the solids, and the propane vapor, together with some entrained fines, is transferred along line 108 to fines removal means 110, e.g. a filter system. The cleansed propane vapor is fed through line 112 as another input to exhaust flash drum 78. The resulting dried solids are transported through line 114 to solids storage bin 116. Similarly, any fines removed in removal means 110 are transferred to solids storage bin 116 through line 118.

The solids in bin 116, now with a lowered BTU/lb value, are fed through solids transport means 120, such as belt or auger feed or the like, to primary solids incinerator 122 where the solids, serving as a primary fuel, are thermally decomposed, for example, at an average temperature of about 876° C. As is well known in the art, secondary fuel may be introduced into incinerator 112 to aid combustion if necessary, and a part of the organics stored in extract storage means 102 may be so used if desired. The ash from incinerator 122 is dumped through exhaust discharge port 124; the combustion gases from incinerator 122 are vented through conduit 126 to afterburner 128. The organics stored in storage 102 are drawn through line 130 by pump 132 and transferred through line 134 to afterburner 128 as the primary feed. In afterburner 128, because of the relatively higher BTU/lb value of the organics feedstock, the temperature of combustion can be considerably higher (e.g. 1200° C.) and thus any partially burned gases in the gaseous effluent from incinerator 122 will be completely oxidized or decomposed. The flue gases from afterburner 128 are discharged through conduit 136 to, if desired, means 138 for cooling and/or scrubbing the flue gases, and may be vented therefrom through chimney 140.

A number of different waste feed stock sludges were treated in accordance with the principles of the present invention and the results are shown in the following table:

TABLE

| Sample No. | Original Average BTU/Lb | Treated Feed Average BTU/Lb | % Extracted Organic by wt. |
|---|---|---|---|
| 1 | 9740 | 9005 | 50% |
| 2 | 7230 | 6833 | 2% |
| 3 | 14532 | 14312 | 20% |
| 4 | 7050 | 5050 | 19% |
| 5 | 8450 | 7450 | 36% |
| 6 | 4350 | 2050 | 5% |
| 7 | 7450 | 7298 | 23% |

It will be appreciated that in operation of an incinerator system of the present invention, not only will the burning of the organic fraction in an afterburner generate flue gases that provide considerably less air pollution, but the reduction shown in the Table above in BTU/lb for the feedstock provided to the solids portion of the incinerator will permit higher feed rates generally compared to incinerators of the prior art.

Since certain changes may be made in the above apparatus and method without departing from the scope of the invention herein involved, it is intended that all matter contained in the above description or shown in the accompanying drawing shall be interpreted in an illustrative and not in a limiting sense.

What is claimed is:

1. Apparatus for incinerating waste material having an organics content, said apparatus comprising, in combination:

pressure vessel means for effecting contact of said organics with a pressurized extractant fluid in which at least a fraction of said organics are soluble so as to produce a fluid extract of said organics in said extractant fluid and a non-extracted residue of reduced BTU/lb value; said extractant fluid being a gas at ordinary conditions of temperature and pressure but in said pressure vessel means being under conditions of temperature and pressure sufficient to render said extractant fluid a solvent for said fraction of said organics;

means for separating said residue from the organics extracted from said waste material;

an incinerator having a flue gas outlet;

means for feeding said residue to said incinerator for incineration therein; and means for feeding said fraction of said organics as a fuel for at least part of said incineration.

2. Apparatus as defined in claim 1 wherein said means for separating said organics from said residue comprises:

first means for separating said residue from said fluid extract; and second means for separating said extractant fluid from said organics in said fluid extract.

3. Apparatus as defined in claim 2 including first storage means for storing a pressurized supply of said extractant fluid, and means for recycling to said first storage means extractant fluid separated by said second means for separating.

4. Apparatus as defined in claim 2 wherein said second means for separating said extractant fluid comprises distillation vessel means capable of separating a still feed from an overhead vapor and liquid bottoms and having associated therewith reboiler means including heat exchange means for circulating a heat transfer fluid therethrough in indirect heat exchange relationship with said liquid bottoms; and first pressure line means arranged for feeding said fluid extract to said distillation vessel means as a still feed from said means for separating said extractant fluid from said organics.

5. Apparatus as defined in claim 4 including fluid extract pressure reducing means associated with said first pressure line means, for reducing the pressure on said fluid extract upon feeding said fluid extract as a still feed to said distillation vessel means.

6. Apparatus as defined in claim 2 wherein said pressure vessel means comprises a counter-current system having at least two extraction stages and including pressure line means for feeding said extractant fluid under pressure to each of said stages, and wherein said first means for separating said residue from said fluid extract comprises a first separator and a second separator;

said first separator being coupled between said stages for separating at least a major portion of said fluid extract from said residue in the output from the first of said stages so that said residue and a minor amount of said fluid extract then constitute a feed for the second of said stages;

said second separator providing means for separating said residue from the major portion of the fluids content in the output of said second stage;

said apparatus further including means for recycling said major portion of said fluids content to provide an input feed to said first stage of said counter-current system.

7. Apparatus as defined in claim 1 including an afterburner connected to said flue gas outlet of said incinerator, and wherein said means for feeding said fraction of said organics is connected for feeding the latter into said afterburner for incineration therein together with flue gas from said incinerator.

8. Apparatus as defined in claim 7 wherein said means for separating said organics from said residue comprises:

first means for separating said residue from said fluid extract; and second means for separating said extractant fluid from said organics in said fluid extract.

9. Apparatus as defined in claim 8 including second storage means for storing said organics following separation thereof by said second means for separating, said means for feeding said organics to said afterburner comprising pump means for transferring said organics from said second storage means to said afterburner.

10. A process for incinerating waste material having an organics content, said process comprising the steps of:

contacting said waste material with an extractant fluid under conditions of temperature and pressure to render said fluid a solvent for a fraction of said organics content so as to form a fluid extract of said organics in said extractant fluid and a non-extracted residue, said fluid being a gas at ordinary conditions of temperature and pressure;

separating said residue from said fluid extract;

incinerating said residue; and feeding said fraction of organics as a fuel for at least part of said incinerating.

11. A process as defined in claim 10 wherein said fraction of organics is incinerated together with the flue gases from the incineration of said residue.

12. A process as defined in claim 10 wherein said extractant fluid is propane.

13. A process as defined in claim 10 including the step of separating said organics from said extractant fluid in said fluid extract before incinerating said fraction of organics.

14. A process as defined in claim 13 including the step of recycling extractant fluid separated from said organics, for use in said step of contacting said waste material.

* * * * *